US007237415B2

(12) United States Patent
Wu

(10) Patent No.: US 7,237,415 B2
(45) Date of Patent: Jul. 3, 2007

(54) METHOD FOR PRODUCING SLIDE SEAT AND ITS MANUFACTURE DEVICE

(76) Inventor: Lei-Jui Wu, No. 13, Fang Yuan Hsiang, Hou Liao Tsun, Kung Chu 4 Road, Chang Hua Hsien (TW)

( * ) Notice: Subject to any disclaimer, the term of this patent is extended or adjusted under 35 U.S.C. 154(b) by 0 days.

(21) Appl. No.: 11/187,814

(22) Filed: Jul. 25, 2005

(65) Prior Publication Data

US 2007/0017270 A1 Jan. 25, 2007

(51) Int. Cl.
*B21B 15/00* (2006.01)

(52) U.S. Cl. ..... 72/206; 72/256; 72/234

(58) Field of Classification Search ..... 72/234, 72/206, 256, 177, 176
See application file for complete search history.

(56) References Cited

U.S. PATENT DOCUMENTS 3,782,164 A * 1/1974 Felker ..... 72/274
5,272,899 A * 12/1993 Mediate ..... 72/177
5,964,118 A * 10/1999 Kamata ..... 72/286

* cited by examiner

*Primary Examiner*—Lowell A Larson
*Assistant Examiner*—Debra Wolfe
(74) *Attorney, Agent, or Firm*—Troxell Law Office, PLLC

(57) ABSTRACT

An improved method for producing slide seat and manufacture device, in which, one metal bar passes through the tamping drum groups arranged in tandem, apply the progressive model of slide seat mounted on the middle section of tamping drum to tamp gradually, meanwhile, the tamped metal bar is extruded so that the material is extruded towards the back section of the not extruded molding and is extended naturally, then apply one protruding edge that is similar to the inner mold of this embryonic form at the back section of molded embryonic form of slide seat, the protruding edge of this inner mold can extrude the inward concave track at inward side of slide seat when slide seat passes through this extending mold, as this slide seat is molded, this inward concave track is molded as well, the sliding faces of inner mold of this extending mold may smooth all edges of slide seat correspondingly so as to make smooth face without processing with milling cutter and roll-wheel-type-cutting knife, therefore, this improved method is useful for quick molding, reducing procedure of processing and saving material.

3 Claims, 5 Drawing Sheets

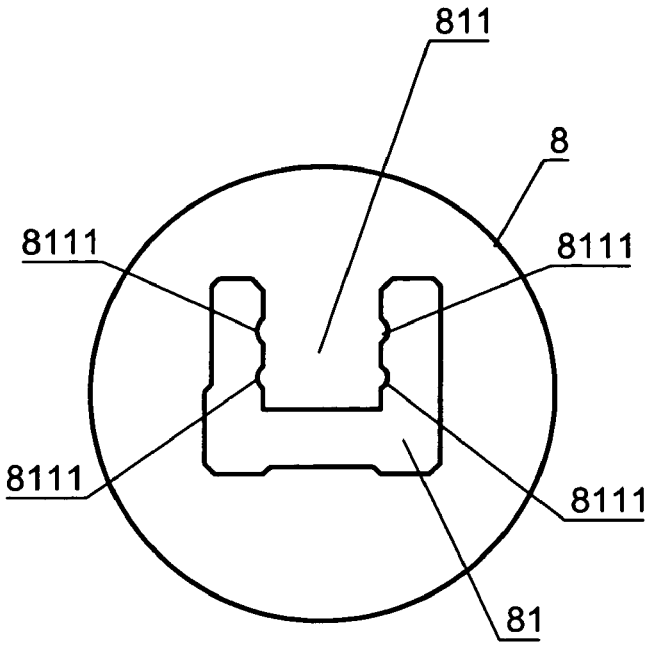
Fig. 5
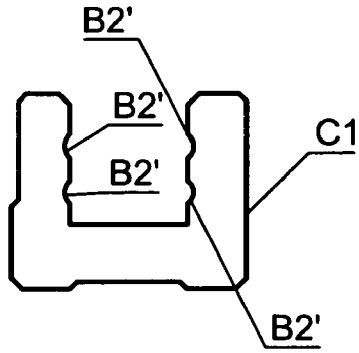
Fig. 5-A
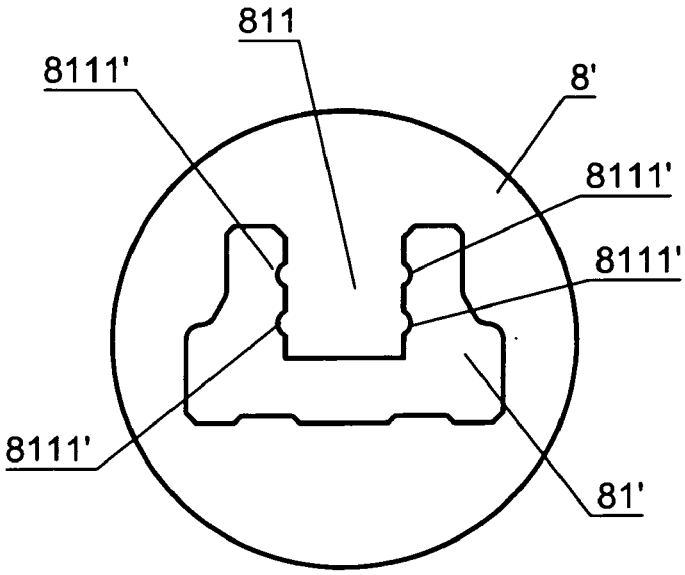
Fig. 6
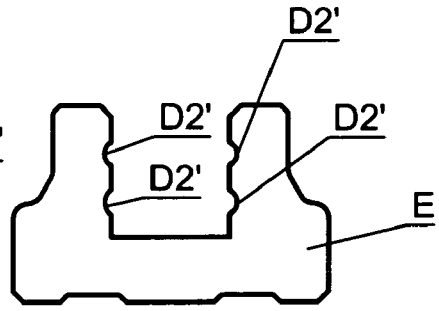
Fig. 6-A

METHOD FOR PRODUCING SLIDE SEAT AND ITS MANUFACTURE DEVICE

BACKGROUND OF THE INVENTION

1) Field of the Invention

This invention relates to an improved method for producing a slide seat and its manufacture device.

2) Description of the Prior Art

The current method for producing a slide seat is to forge first one preliminary cast of a slide seat in a proper length, and then mold the face and edge by using a milling cutter and making an inward concave track on two sides of the finished slide seat by using a roll-wheel-type-cutting knife.

SUMMARY OF THE INVENTION

1. Problems to Solve:

(1) The prior arts manufacture process is complicated because each edge must be molded separately, so the manufacture speed is very slow, and due to the complicated procedure of processing, there is a greater chance of an error occurring.

(2) The thickness of the prior art's forged preliminary cast of a slide seat must be increased because its face must be molded again so as to reserve the surplus thickness for molding the face and edge. As a result, material costs are increased, and the filings produced during the course of processing is waste.

(3) The prior arts slide seat is required to forge one connector, one molding and one preliminary cast. As a result, the length of its preliminary cast is limited and each molded slide seat can only provide one processing procedure and the milling cutter and roll-wheel-type-cutting knife cannot make deep-processing. Therefore, the prior art system is not well suited for mass production.

2. Solutions:

(1) This invention is to apply tamping drums arranged in parallel and these several groups of tamping drums are arranged in tandem. One model is mounted on each group of tamping drums, based on the shape of the slide seat. This model is progressively pushed on this tamping drum so that this tamping drum group can rotate, applying one metal bar (which can be replaced by metal bars with different shapes) to pass through the model mounted on each tamping drum group in proper sequence so as to tamp the metal bar into the embryonic form of a slide seat in the desired shape gradually. The surplus material may be extended back and no material will be wasted. The final molded extending mold has an inner mold similar to the embryonic slide seat and a protruding edge in the required shape set at two sides of throat of this inner mold. When the embryonic slide seat passes through the inner mold by pushing, an inward concave track in the desired shape and quantity is formed at the inward side of the slide seat. Meanwhile, the inner mold of may shape and smooth the edges of the slide seat so that it does not require face processing and can be molded quickly. Furthermore, waste in producing the slide seat is decreased, thus decreasing processing complexity and cost accordingly.

(2) The manufacture device of this invention is applicable to producing of slide seats of different shapes, based on the shape of the slide seat requiring molding, Each tamping model is set in proper sequence on a respective tamping drum group, and the metal bar is tamped progressively into the final embryonic form of a slide seat Then the inner mold of the extending mold is applied to produce a shape similar to the embryonic form of slide seat. Meanwhile, with the protruding edge of the required shape and quantity at the two sides of this inner mold's throat, the inward concave track is drawn out in the desired shape and quantity at the two inward sides to form the embryonic slide seat's U-shaped groove.

BRIEF DESCRIPTION OF THE DRAWINGS

FIG. 1-A~F is a series of cross sections of the first example of the embryonic slide seats manufacturing flow.

FIG. 3-A is the a perspective of the first executive example of slide seat molding during cutting.

FIG. 3-B is a perspective view of the slide seat molding after cutting.

FIG. 4-A is another perspective view of the second embodiment of the device.

FIG. 4-B is a perspective view of the slide seat molding after cutting.

FIG. 5 is cross section of a third embodiment of the extending mold.

FIG. 5-A is a cross section of the third embodiment of the embryonic slide seat.

FIG. 6 is a cross section of a fourth embodiment of the extending mold.

FIG. 6-A is a cross section of a fourth embodiment of the embryonic slide seat.

DETAILED DESCRIPTION OF THE PREFERRED EMBODIMENTS

Figure 1:
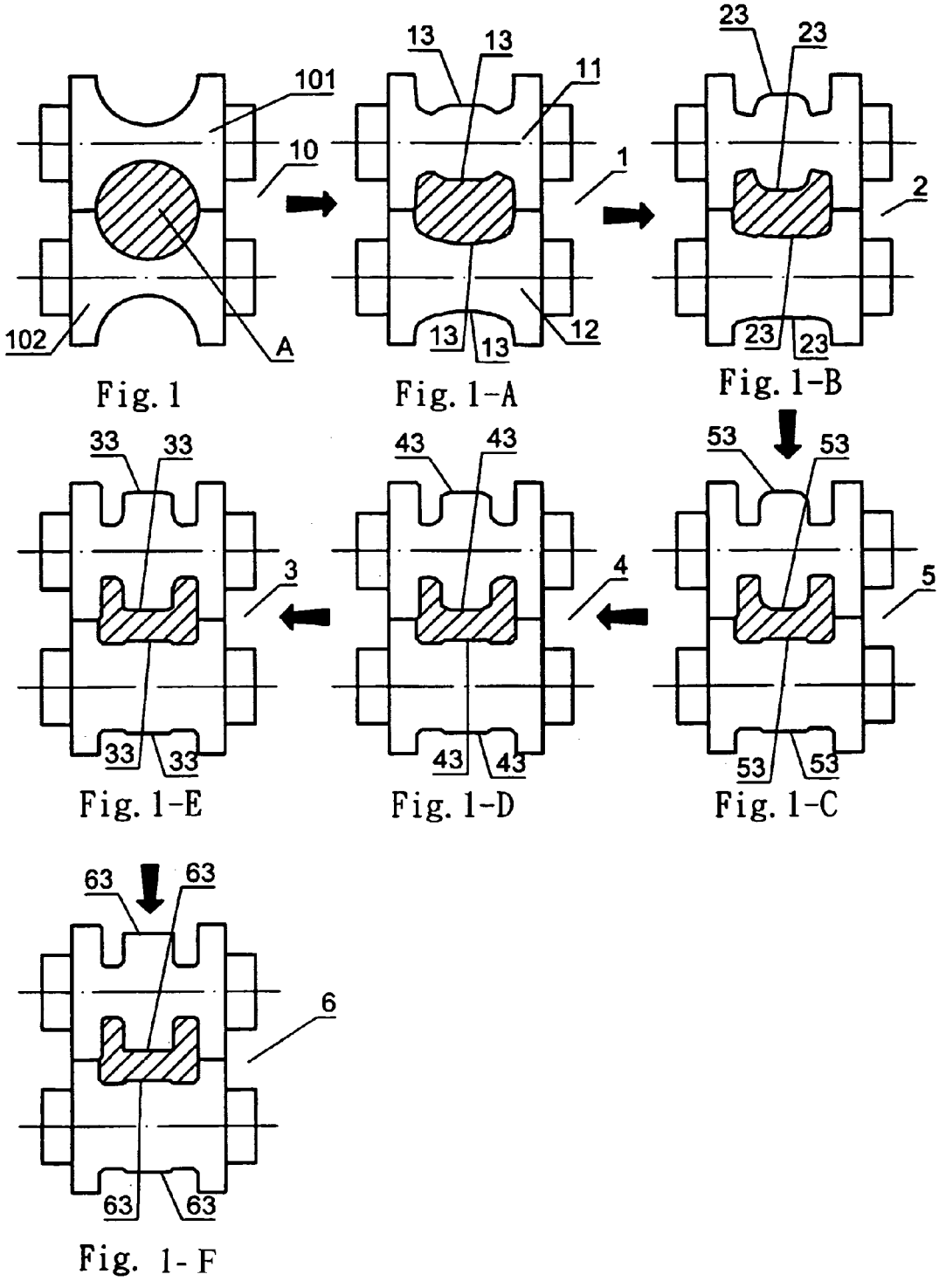
FIG. 1 is a cross section of a transmission drum group of this invention.
Figure 2:
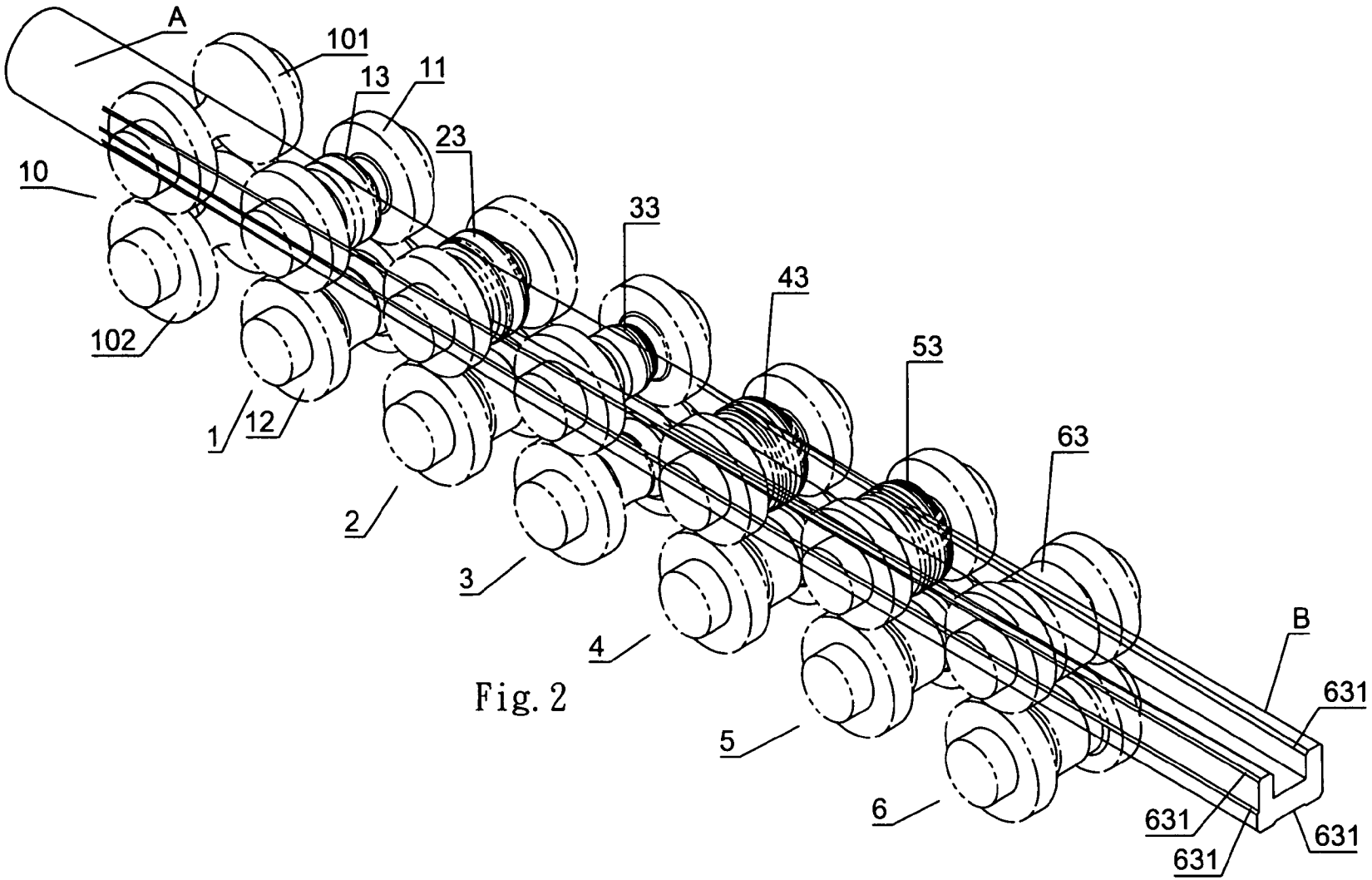
FIG. 2 is a perspective view of the tamping drums arranged in series.

Please refer to FIG. 1, FIG. 1-A~F and FIG. 2, the metal bar A (which can be substituted with a metal bar in different shapes) is tamped by the tamping model mounted on the tamping drum group (such as FIG. 1-A~F). To conveniently describe the manufacture flow of this invention, the following descriptions are based on the executive example of molding process of several types of tamping models. However, the number of this flow may not be restricted by the quantity of tamping drum group shown in Fig-A~F. The number of tamping drum groups may be changed according to the shape of practical manufactured slide seat B (FIG. 3) and D (FIG. 4-A). As shown in FIG. 1, the upper drum 101 and lower drum 102 of the transmitting drum 10 push the metal bar A. As shown in FIG. 1-A, according to the tamping drum 1, the tamping model is mounted on its upper tamping drum 11 and the lower tamping drum 12 and the tamping model 13 is molded slightly as these two models are arranged in parallel. FIG. 1B~F and FIG. 2 show tamping drum 2,3,4,5,6 arranged according to the front sequence of this tamping drum 1. The tamping model 23,33,43,53,63 are mounted on each respective tamping drum are the shape of embryonic slide seat B (such as FIG. 1-F and FIG. 2) that is molded in proper sequence. The above described tamping model 23,33,43,53 and 63 can also be mounted according to the shape of slide seat D in FIG. 4 and tamped into the embryonic slide seat D in FIG. 4 in proper sequence based on the same method as shown in FIG. 2, so that all edges 631 may be molded without further processing. The above described tamped material is extended back by tamping so as to save material.

Figure 3:
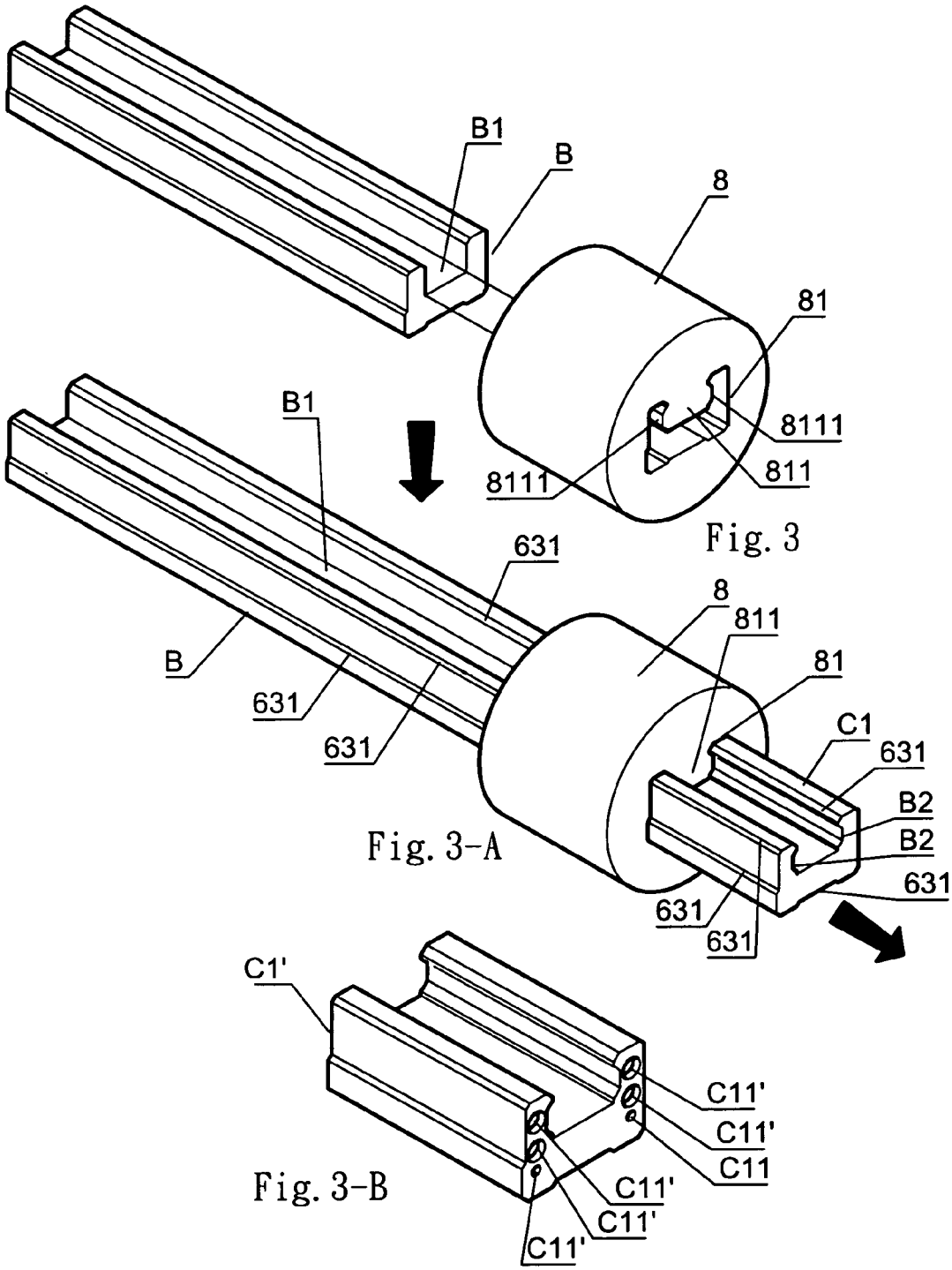
FIG. 3 is a perspective view of the slide seat molding before cutting.
Figure 4:
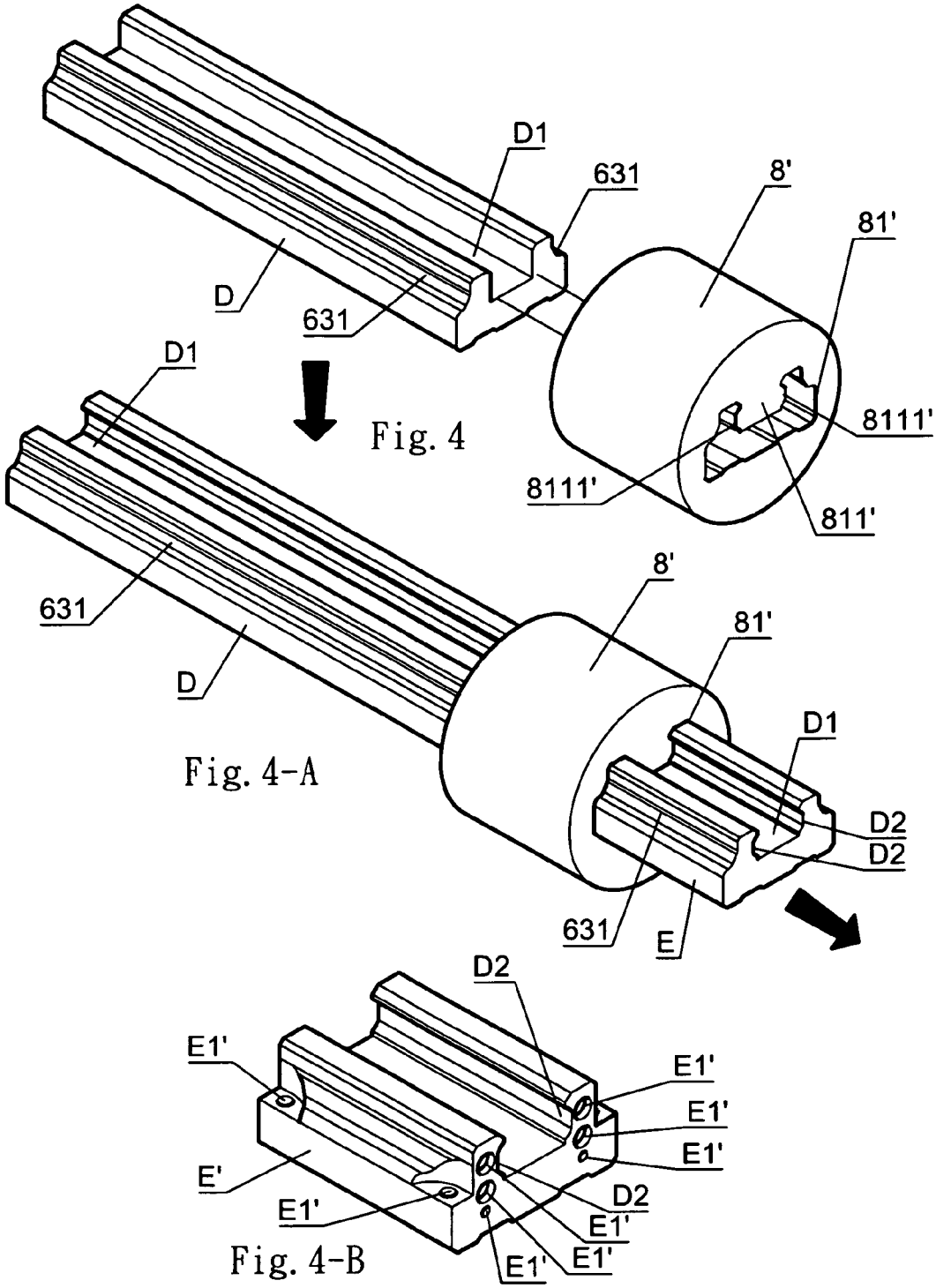
FIG. 4 is a perspective view of a second embodiment of the device.

Please refer to FIG. 3, FIG. 3-A, B and FIG. 4, FIG. 4-A, B. When the embryonic slide seat B and D is molded, and then passes through one extending mold 8,8', the shape of the inner mold 81,81' of this extending mold 8,8' is similar to the shape of this embryonic slide seat B and D. Only the protruding edge 8111,8111' at the end of two sides of throat 811,811' of this inner mold 81,81' in the required quantity and shape are mounted. The width of the terminal protruding edge 8111, 8111' is slightly larger than that of B1,D1 of the U-shaped groove of slide seat B,D. When the embryonic slide seat B and D finishes all steps with the above described moldings, which, once again is pressed to pass through the inner mold 81,81' of this extending mold so that the two sides of the shaped groove B1,D1 are extruded by this protruding edge 8111,8111' and shape the inward concave track B2 and D2 (such as FIG. 3-A and FIG. 4-A) in the desired quantity and shape that are the same as this protruding edge 8111,8111'. As a result, the edges of this molded complete slide seat C1,E are smoothed by the sliding face of inner mold 81,81' and the sliding face is formed. Therefore, the sliding face does not need further processing and may be molded quickly, thus saving material and reducing cost. When desired, the slide seat C1,E are cut off again to obtain the required length C1',E' as shown in FIG. 3-B and FIG. 4-B.

Please refer to FIG. 3-B and FIG. 4-B. When the cutting slide seat C1',E' is cut off as required, then several holes C11', E1' are formed by drilling and processing, which can provide fixing or lubricating oil to the sliding track.

Please refer to FIG. 2, FIG. 5 and FIG. 6, according to the above described molding modes, the quantity of tamping drum group 1,2,3,4,5,6 and the shape of tamping model 13, 23,33,43,53 and 63 can be changed in accordance with the shapes of the molded embryonic slide seat B,D (such as FIG. 3 and FIG. 4), and the protruding edge 8111,8111' at two sides of throat 811,811' of the inner mold 81,81' of extending mold 8,8' of manufacture device can also be modified for a desired quantity and shapes according to the types of slide seat (such as FIG. 5 and FIG. 6-A) so as to provide an inward concave track B2', D2' (such as FIG. 5-A and FIG. 6-A) in the required shape and quantity drawn out by slide seat C1' and E'.

What is claimed is:

1. An improved method for producing a slide seat, comprising the following steps:

(a) arranging a series of tamping models mounted on each of a plurality of groups of tamping drums located in tandem;

(b) pushing a metal bar into the first tamping model to form a tamped metal bar;

(c) feeding the metal bar continuously through the series of tamping models so that the tamped metal bar is gradually molded into an embryonic slide seat having a U-shaped groove;

(d) tamping the embryonic slide seat through an inner mold of an extending mold; and (e) applying a protruding edge of the extending mold to two sides of the U-shaped groove of the embryonic slide seat to extrude an embryonic slide seat with tracks within the U-shaped groove.

2. A slide seat manufacturing device, comprising:

a plurality of groups of tamping drums, with each group of tamping drums comprising an upper drum and a lower drum arranged in parallel to form a tamping model, each tamping model being arranged in tandem to extrude a U-shaped embryonic slide seat when a metal bar is fed through the plurality of groups of tamping drums; and an extending mold having an inner mold fixed inside of the extending mold with a protruding edge fixed on two sides of a throat of the inner mold, so that the U-shaped embryonic slide seat is extruded with tracks on the interior walls of a U-shaped groove in the U-shaped embryonic slide seat.

3. The slide seat manufacturing device of claim 2, wherein the extending mold has more than two protruding edges.

* * * * *